US007493921B2

(12) United States Patent
Mettler et al.

(10) Patent No.: US 7,493,921 B2
(45) Date of Patent: Feb. 24, 2009

(54) YARN-PROTECTING HEALD

(75) Inventors: Franz Mettler, Wollerau (CH); Herbert Schwane, Raesfeld (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 11/477,401

(22) Filed: Jun. 30, 2006

(65) Prior Publication Data

US 2007/0000552 A1 Jan. 4, 2007

(30) Foreign Application Priority Data

Jul. 1, 2005 (DE) ..... 10 2005 030 632

(51) Int. Cl.
*D03C 9/02* (2006.01)
*D03C 9/04* (2006.01)
*D03C 13/00* (2006.01)

(52) U.S. Cl. ..... 139/93; 139/52; 139/53

(58) Field of Classification Search ..... 139/52, 139/93, 192, 53, 94, 95
See application file for complete search history.

(56) References Cited

U.S. PATENT DOCUMENTS 1,932,350 A 10/1933 Marx
4,383,557 A * 5/1983 Graf ..... 139/93
4,529,014 A * 7/1985 Rast et al. ..... 139/435.6
4,822,662 A * 4/1989 Ishii et al. ..... 428/131
5,052,446 A * 10/1991 Gysin ..... 139/93
5,348,055 A * 9/1994 Kramer ..... 139/93
5,474,110 A * 12/1995 Mettler ..... 139/93
5,511,587 A * 4/1996 Miya et al. ..... 139/192
5,658,394 A * 8/1997 Meroth ..... 148/222
5,758,696 A * 6/1998 Nishikawa ..... 139/1 R
5,983,951 A * 11/1999 Taniguchi et al. ..... 139/1 R
6,145,549 A * 11/2000 Euerle et al. ..... 139/93
6,213,162 B1 * 4/2001 Baechtold ..... 139/93
6,283,163 B1 * 9/2001 Kagi ..... 139/93
6,883,553 B2 * 4/2005 Bassi et al. ..... 139/93
7,131,465 B1 * 11/2006 Chapman ..... 139/93
2007/0131301 A1 * 6/2007 Mettler ..... 139/52

FOREIGN PATENT DOCUMENTS

DE 43 36 362 10/1994
EP 0 403 429 6/1990
JP 11 107082 4/1999

* cited by examiner

*Primary Examiner*—Bobby H Muromoto, Jr.
(74) *Attorney, Agent, or Firm*—Fitch, Even, Tabin & Flannery; Norman N. Kunitz

(57) ABSTRACT

A heald having a heald body (8), whose thickness increases toward the yarn eyelet (6). The lateral surfaces of the heald body (8) constitute guiding surfaces which are oriented in the warp yarn direction and which, adjacent the yarn eyelet (6), serve as spacers (35, 36) for holding at a distance adjoining yarn eyelets (6) of adjoining healds.

23 Claims, 6 Drawing Sheets

YARN-PROTECTING HEALD

CROSS REFERENCE TO RELATED APPLICATION

This application claims the priority of German Patent Application No. 10 2005 030 632.2-26, filed on Jul. 1, 2005, the subject matter of which, in its entirety, is incorporated herein by reference.

BACKGROUND OF THE INVENTION

The invention relates to a heald for a heald shaft, having features as defined in the preamble of claim 1.

It has long been a desideratum to reduce the mass of weaving components which include heald shafts and healds. A reduction of the mass of weaving components is being sought after for significantly relieving the shaft drive and the shed forming machines, for saving energy and also, for achieving higher rpm's, while no increase in wear occurs but, on the contrary, even a reduction in wear may be obtained.

During shed-forming, the healds move the warp yarns, running through their yarn eyelet, out of the plane of the warp yarns, while other warp yarns running between the healds are moved by another other heald shaft in the same, or in the opposite direction. In this manner during each shed-forming process, the tensioned warp yarns run along the outer side of a heald. Such an occurrence causes an extreme stress on the yarns which may lead to warp yarn damage and, in an extreme case, to warp yarn breakage.

DE 43 36 362 C1 discloses a heald having a specially shaped yarn eyelet. The lead consists of a suitably shaped flat material. In the region of the yarn eyelet it is twisted in such a manner that the flat sides are oriented at an inclination to the warp yarn direction. The warp yarns which are situated between the healds and which do not run through the yarn eyelet, have to brush against the outer edges of the yarn eyelet and may thus be damaged.

The same document further discloses a heald which is not twisted in the region of its yarn eyelet, but in which the two webs bordering the yarn eyelet are merely bent in opposite directions. In this manner both lateral surfaces of the heald are, along their respective entire length, oriented in the warp yarn direction. It is noted, however, that because of bending the yarn eyelet webs, in the yarn eyelet at both the upper and the lower end a respective sharp corner is formed which may tend to provide a cut in a warp yarn. Further, the outward laterally bent legs do not prevent the adjoining healds from approaching one another so closely that one leg of an adjoining heald intersects the yarn eyelet of the other heald. This too, may result in the warp yarns to run up and down on the more or less sharp edges of the heald to thus cause yarn damage.

EP 0403429 discloses a heald made of a fiber-reinforced plastic. The heald body is provided with rounded edges in the region of the yarn eyelet, as well as in portions extending away therefrom. Similarly to the previously discussed heard, here too, adjoining yarn eyelets may overlap one another. This may cause damage to the yarns which run between the healds and which must pass by the yarn eyelet during shed-forming. This applies particularly at high operating speeds.

Accordingly, it is the object of the invention to provide an improved heald.

SUMMARY OF THE INVENTION

The heald according to the invention has a heald body which is provided with a spacer means at the yarn eyelet. The spacer means prevents adjoining healds in the region of the yarn eyelets from overlapping, as looking in the warp yarn direction. In this manner a yarn, running between the healds, is only inappreciably, if at all, forced out of the warp yarn direction when it passes by the yarn eyelets of the adjoining healds. In particular, the warp yarn is not forced onto the edges of the healds or the edges of the yarn eyelets on which the warp yarn could be damaged. Particularly thermally sensitive yarns, which could be damaged not only by the sharp edges, but also by friction heat, may be processed in this manner at high operating speeds. By avoiding a heald overlap, particularly in the region of the yarn eyelets, a low-deflection and thus low-friction run of the warp yarns is possible both as concerns their longitudinal motion (in the warp yarn direction) and their shed-forming motion.

The lateral surface is oriented preferably in the warp yarn direction along its entire length which is effective in shed-forming. This applies particularly for the regions-adjoining the yarn eyelet and the yarn eyelet itself. In this manner damage to the yarn passing by the heald is prevented precisely at the constriction formed by the yarn eyelet.

In this arrangement it is advantageous to round the front and rear edges of the healds; this further reduces stress on the yarns.

The lateral surface is preferably a planar surface at the yarn eyelet. The webs bounding the yarn eyelet need not be laterally arcuate; rather, they may be essentially straight. In this manner the possibility is provided for defining the inner contour of the yarn eyelet in such a manner that no upper or lower pointed corners are obtained in which the warp yarn may be wedged and damaged. Further, the yarn running past the yarn eyelet is prevented from remaining suspended thereon.

The spacer means is preferably formed by a portion of the lateral surface which adjoins the yarn eyelet. Such a surface portion can be found, for example, immediately above or below the yarn eyelet, assuming a vertical length direction of the heald. In such a region the heald body is as thick as the distance of the lateral surfaces of the webs in the region of the yarn eyelet. In this manner yarn eyelets of adjoining healds cannot overlap. A yarn, running past the yarn eyelet between the healds during shed-forming, crosses over the yarn eyelets essentially without hindrance.

The lateral surfaces are preferably formed as ramp surfaces for securely guiding the yarn crossing over the yarn eyelet. The ramp surfaces are preferably planar; they may be, however, slightly arcuate.

The distance between the two oppositely located lateral surfaces in the region of the yarn eyelet, that is, the thickness of the heald body above and below the yarn eyelet is greater than the width of the yarn eyelet measured in the same direction. Such an arrangement contributes to maintaining the desired yarn eyelet distance. Stated differently, the division given by the warp yarn running through the yarn eyelet, that is, the center distance between adjoining yarn eyelets may not become less than the external width of the yarn eyelets and definitely not less than the inside width thereof, even if adjoining healds move toward one another to the closest possible extent.

The yarn eyelet is preferably bordered by webs whose inner sides form guiding surfaces which are parallel to the lateral surfaces. Such an arrangement results in a gentle handling of the yarn as it runs through the yarn eyelet. Further, the yarn eyelet is adjoined at the top, as well as at the bottom, by preferably planar or slightly arcuate surfaces which extend in the warp yarn direction and which are essentially smooth to also serve for a gentle handling of the yarn during its run. These surfaces are arcuate in a direction away from the yarn eyelet at the yarn-inlet side of the heald and, if required, also at the yarn-outlet side of the heald. This results in a gentle handling of the yarn, particularly in case of an open shed.

The webs bordering the yarn eyelet are preferably offset with respect to one another relative to the warp yarn direction, whereby a warp direction distance is obtained. Further, the webs are offset with respect to one another transversely to the warp yarn direction, whereby a transverse distance is obtained. The warp direction distance is preferably greater than the transverse distance. In this manner an automated yarn draw-in is readily feasible in such healds, while the healds remain sufficiently slender for processing even very thin yarns.

The lateral surface may be provided with a recess, such as a groove extending in the length direction L of the heald. Such an arrangement substantially reduces the mass of the heald without appreciably adversely affecting the strength thereof. The heald body may be made of plastic which has advantages concerning weight. Further, the heald may be of a fiber-reinforced material, such as aluminum with boron fibers which results in a light and strong structure. It is also feasible to form the heald body seamlessly from one and the same material to thus obtain a one-piece component. This prevents weak locations and provides for a simple manufacture. The heald body may be provided in its entirety or partially, with a wear-reducing coating, for example, particularly in the region of the yarn eyelet, inside as well as at its lateral surfaces. Such a measure particularly prevents a yarn from sawing itself into the yarn eyelet.

The yarn eyelet may also be made of a wear-resistant insert, such as ceramic, tungsten carbide, or a hard metal and, if required, the insert may be provided with a coating. In this manner light and, at the same time, highly wear-resistant healds are obtained.

Special details of embodiments of the invention result in further advantages and are subject of the drawing, the description or the claims. Exemplary embodiments of the invention are shown in the drawing.

DETAILED DESCRIPTION OF THE DRAWINGS

Figure 1:
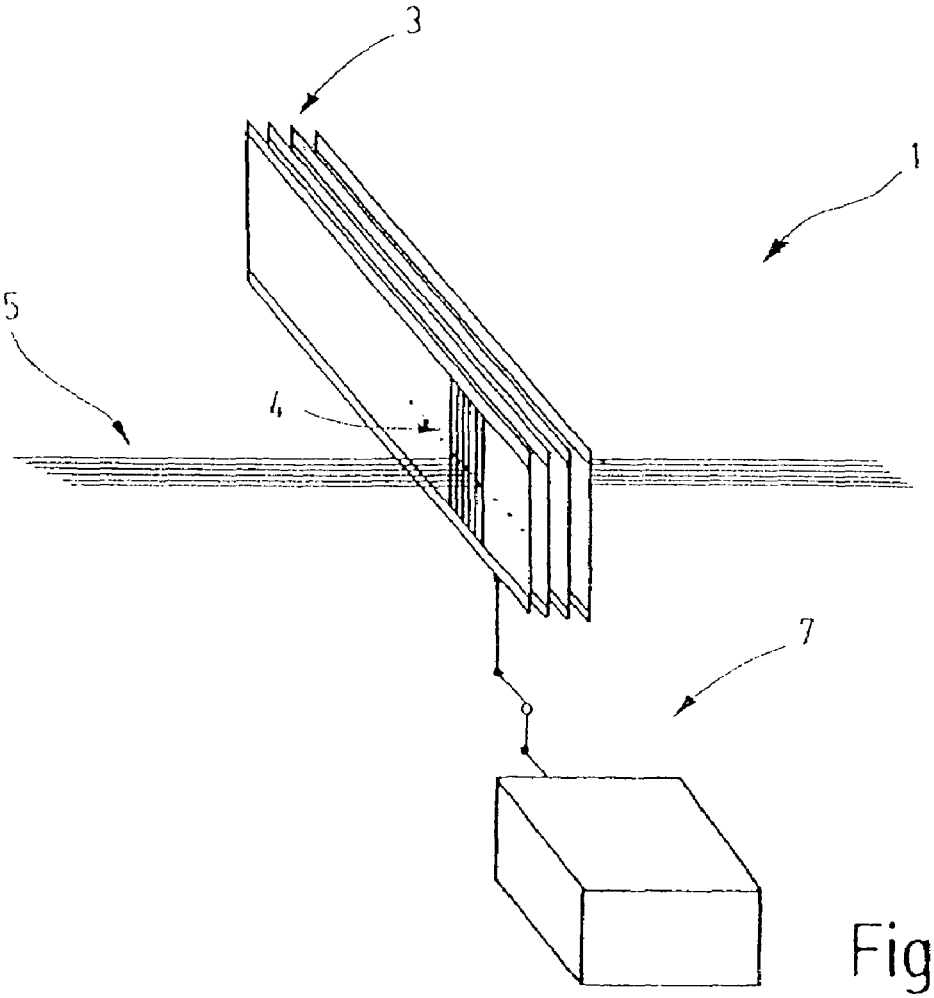
FIG. 1 is a highly schematic fragmentary illustration of a weaving machine.
Figure 2:
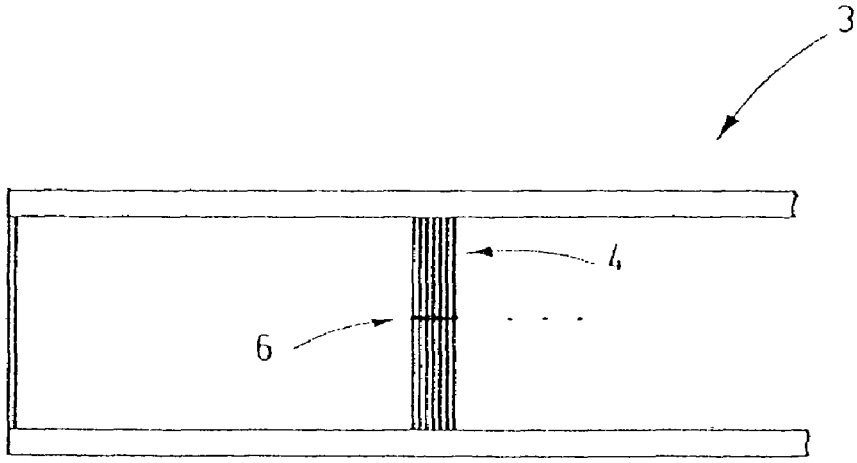
FIG. 2 is a schematic fragmentary front view of a heald shaft of the weaving machine according to FIG. 1.

FIG. 1 shows some. components of a weaving machine 1 which includes heald shafts 3 with healds 4. The heald shafts 3 are essentially flat, rectangular frames in which the healds 4 are vertically held. The healds 4 serve for guiding the warp yarns 5; some of the warp yarns 5 are guided through respective yarn eyelets 6 and some are guided between the healds. As also seen in FIG. 2, the healds are held essentially in a parallel, side-by-side, closely adjoining relationship. During operation of the weaving machine 1, the heald shafts 3 are moved up and down in rapid succession. For this purpose an only highly schematically shown shaft drive 7 is provided. The healds of a shaft 3 are preferably of identical structure. They have, for example, a shape according to FIG. 3. Each heald 4 has an approximately strip-shaped, elongated heald body 8 which is oriented vertically in use and which, in its mid region, is provided with a yarn eyelet 6. In the present embodiment, C-shaped end eyelets 9, 10 adjoin the heald body 8 at both ends. In the vicinity of the end eyelets 9, 10, serial holes 11, 12, partial slots 13, 14 and severing edges 15, 16, 17, 18 are formed.

Figure 3:
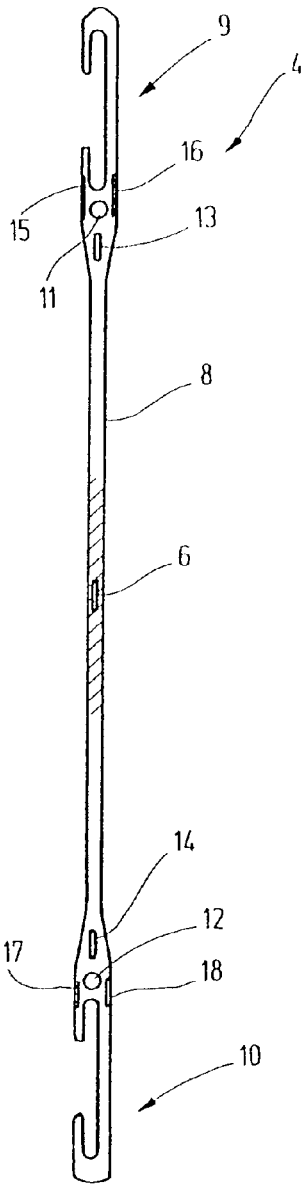
FIG. 3 is a side view of a heald intended for arrangement on the heald shaft according to FIG. 2.
Figure 4:
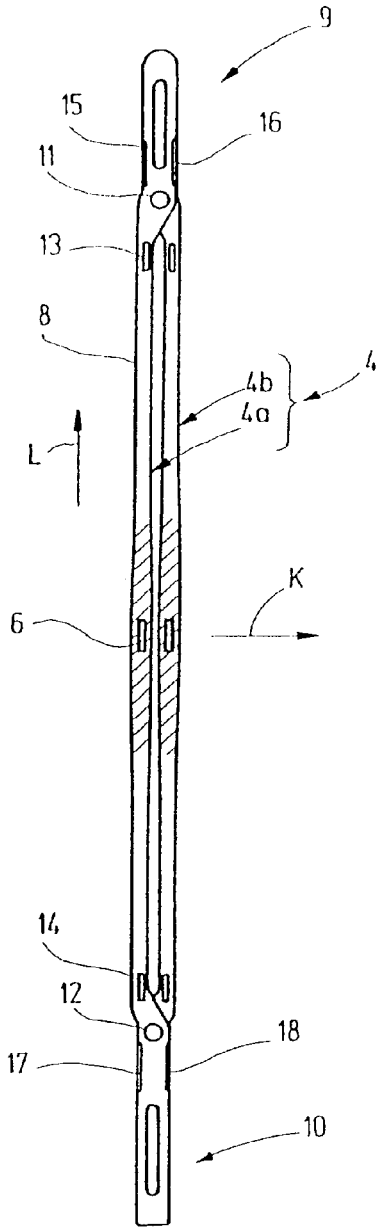
FIGS. 4 and 5 are side views of further embodiments and modes of arrangement of healds with dual yarn eyelet structure for the heald shaft according to FIG. 2.
Figure 5:
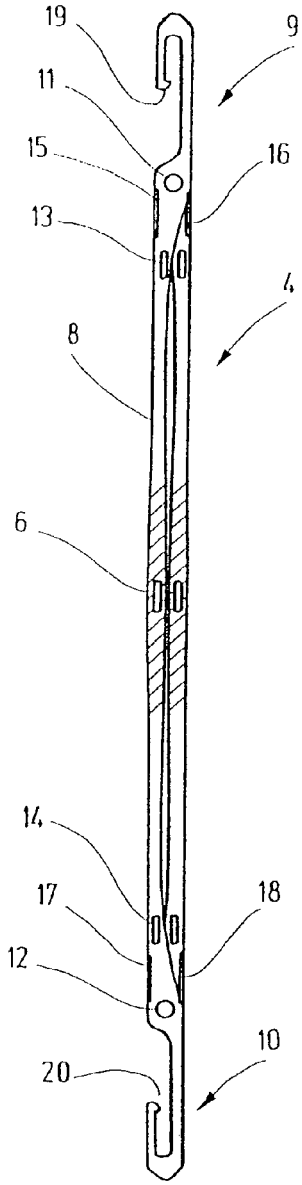

As concerns these fundamental features, the heald 4 according to FIG. 3 essentially agrees with the healds 4 according to FIGS. 4 and 5. Differences are present insofar as the healds 4 according to FIG. 4 have closed end eyelets 9, 10, whereas the healds 4 according to FIG. 5 have J-shaped end eyelets 9, 10, but with inward angled hooks 19, 20. Differences consist further in the alignment between the heald body 8 and the end eyelets 9, 10. While the end eyelets 9, 10 according to FIG. 3 are arranged as linear continuations of the heald body 8, in the healds 4 according to FIGS. 4 and 5 an offset is present which makes it possible to mount adjoining healds 4*a*, 4*b* with an offset relative to the warp yarn direction K. This results in two rows of yarn eyelets, also referred to as dual yarn eyelets. It is further feasible to provide each heald 4 only on one side with severing edges 15, 17 and, respectively, 16, 18.

In the previously described embodiments the heald body 8 consists preferably entirely or in part of a plastic, for example, a fiber-reinforced synthetic material. Carbon fibers, glass fibers or other type of fibers may be used as reinforcing fibers. The fiber length may be uniform and may be, for example, 2 mm. It is also feasible to utilize fiber mixtures having different fiber lengths. The fibers may be oriented purposefully, for example, in the length direction L of the heald 4 or may be embedded into the plastic without a preferred orientation. In this connection preferably glass fiber are used as short fibers in which case then the heald bodies 8 may be manufactured in a usual casting process.

In the alternative, the healds 4 may be, in their entirety or limited only to the heald bodies, made by hot-pressing or forging from a suitable metal, such as magnesium, aluminum, a magnesium alloy or an aluminum alloy. The healds 4 may be provided with a wear-resistant coating, particularly for processing aggressive warp yarns. This applies particularly in the zone of the yarn eyelet 6 as well as the lateral surfaces of the heald body. In case of a heald, which is cast or forged, for example, from an aluminum alloy, the coating is preferably an Eloxal layer.

Figure 6:
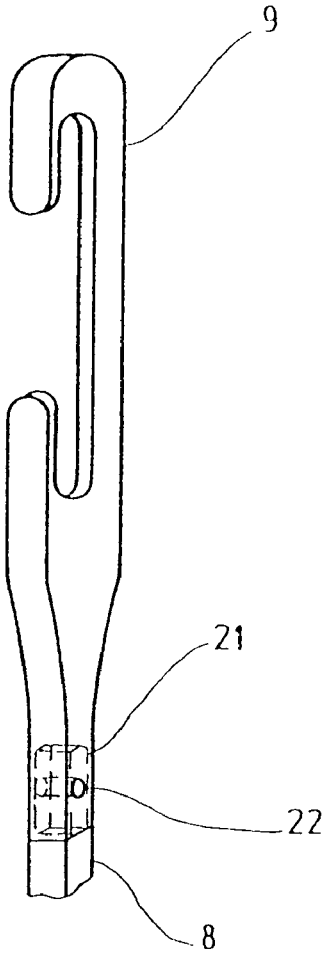
FIG. 6 is a perspective schematic illustration of an appended end eyelet for a heald according to FIG. 3.
Figure 7:
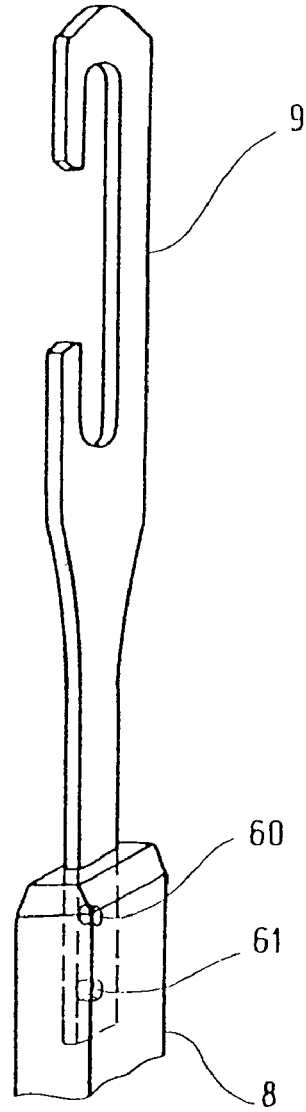
FIG. 7 is a perspective schematic illustration of a modified embodiment of an appended end eyelet for a heald according to FIG. 3.

In the above described embodiments the end eyelet 9, may be a single piece with the heald 4. This means that the end eyelet 9, 10 seamlessly joins the heald body 8 and is made of the same material as the latter. It is, however, possible in the alternative to append the end eyelets on the heald body 8 and, if required, make them from a different material. Embodiments in this connection are illustrated in FIGS. 6 and 7. For example, the end eyelet 9, according to FIG. 6, may have a recess into which extends a projection 21 of the heald body 8. The end eyelet 9 may be secured to the heald body 8 by means of a transverse pin 22 which extends through the recess and the projection 21. This type of connection is particularly adapted for joining the end eyelet 9 to the heald body 8 in case they are of unlike materials. If the heald body 8 is plastic and the end eyelet is, for example, steel, the latter, as shown in FIG. 7, may be cast into the heald body 8. For example, the end eyelet may be placed into the mold and cast with the heald body 8. It is then possible to form the transverse pin from the heald material to thus constitute a component of the heald body 8. A transverse pin formed as a separate part is not necessary in such a case. In case the end eyelet has several holes 60, 61, then, in addition to a material bond, a form-locking attachment is obtained.

For the end eyelets a particularly wear-resistant material, such as tempered steel, tungsten carbide, or ceramic may be used. The attachment of the end eyelets 9, to the heald body 8 is effected, for example, by a form-fit or a material bond by gluing or soldering. If a casting process is used, the heald body 8 may be cast onto the end eyelet 9, 10. In such a case it is possible to form the transverse pin from the heald material to thus become a component of the heald body 8. A separately formed transverse pin is not necessary in such a case.

Figure 8:
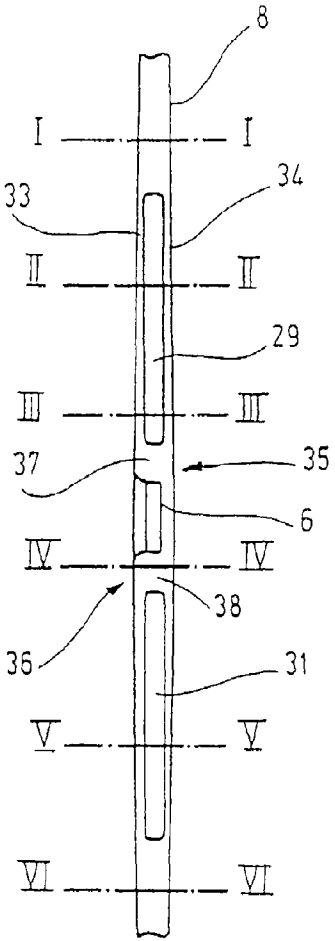
FIG. 8. is a fragmentary side view of a central portion of a heald according to FIG. 3, 4 or 5.

FIG. 8 illustrates the shape of the heald body 8 and particularly that of the yarn eyelet 6. The heald body 8 is provided at several locations with section lines I-I to VI-VI and in FIG. 9 the respective sections are juxtaposed to the section lines. As seen, the heald body 8 has two lateral surfaces 23, 24 (shown, for example, in section I-I or IV-IV) which are planar and are oriented in the warp yarn direction K. They constitute the flat sides of the heald body 8 and merge with rounded edges 25, 26 and, respectively, 27, 28 with the front and, respectively, the rear small sides, as viewed in the warp yarn direction K.

Figure 9:
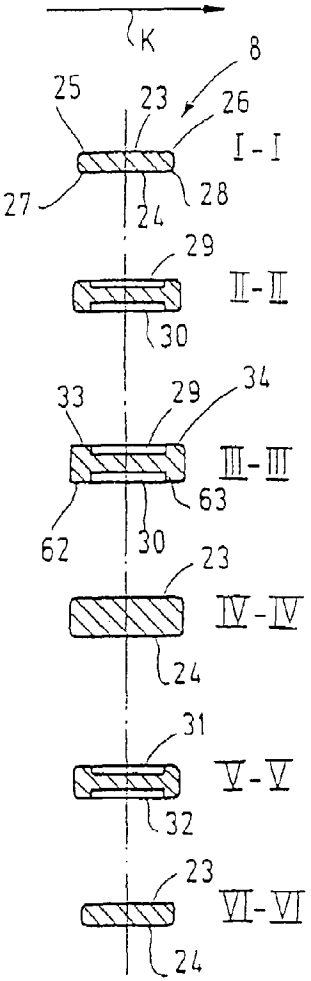
FIG. 9 shows sectional views, at different locations, of the heald according to FIG. 8.

As particularly well seen in FIG. 9, the thickness of the heald body 8, that is, the distance between the lateral surfaces 23, 24 increases toward the yarn eyelet 6. It is also feasible to provide that the dimension, that is, the width of the heald body 8 increases (not shown) toward the yarn eyelet 6. Consequently, the cross section of the heald body increases in the direction of the yarn eyelet 6; such a cross-sectional increase results in the increase of the distance, on the one hand, between the lateral surfaces 23, 24 and, on the other hand, between the narrow sides of the heald body 8. Such an enlargement of the heald body 8 increases the stability thereof in the warp yarn direction K, without, at the same time, reducing the pitch and row density. In the region of the yarn eyelet 6, where the heald body 8 is the thickest, the lateral surfaces 23, 24 preferably form a planar surface. In a ramp-shaped or wedge-shaped region, which extends approximately from the section III-III to the section I-I, the thickness decreases, and the lateral surfaces 23, 24 again form planar surfaces which are oriented at an acute angle to one another. Adjoining the section I-I, the lateral surfaces 23, 24 extend in the direction of the end eyelets 9, 10 preferably parallel to one another, whereby the thickness of the heald body 8 remains constant. In the discussed transitional region between the yarn eyelet 6 and the thinner portion of the heald body 6, slot-like or groove-like recesses 29, 30, 31, 31 may be provided which may be seen particularly in FIG. 9. The recesses 29, 31 and 30, 32 interrupt the lateral surfaces 23, 24 and contribute to a weight reduction of the heald body 8 without adversely affecting its rigidity and its tensile and compression strength. Narrow webs 33, 34 at both sides of the recesses 29, 31 and narrow webs 62, 63 at the recesses 30, 32 remain which form smooth yarn guiding surfaces.

Another particularity of the heald 4 according to the invention resides in the configuration of the yarn eyelet 6. The latter is arranged in the thickest region of the heald body 8. The portion of the heald body 8, situated above and underneath the yarn eyelet and shown in FIG. 9 in section IV-IV, forms a spacer means 35, 36 (FIG. 8). The regions 37, 38 of the lateral surface 23 in that location may arrive into contact with the corresponding surface regions of an adjoining heald, while, however, regions of the heald body 8 of a neighboring heald 4 are prevented from penetrating into the warp yarn space of an adjoining heald. The warp yarn space of a heald 4 is defined by the yarn eyelet and represented by an envelope 48 in FIG. 11. The warp yarn space extends parallel to the drawing plane of FIG. 3. It is of advantage in this connection to provide that the lateral surfaces 23, 24 each extend in their full width—measured in the warp yarn direction K—onto the yarn eyelet 6 and that the lateral surfaces 23, 24 are, for that purpose, oriented in the warp yarn direction K and, with respect thereto, are neither twisted nor inclined.

The yarn eyelet 6 is laterally bounded by two flank-parallel webs 39, 40. The outer sides of the webs 39, 40 are formed by the lateral surfaces 23, 24. The inner sides are formed by the guiding surfaces 41, 42 which are oriented parallel to one another as well as parallel to the lateral surfaces 23, 24. The webs 39, 40 extend parallel to the length direction L of the heald body 8. The webs 39, 40 are offset relative to one another with respect to the warp yarn direction K as well as transversely thereto. Between themselves they form, for the warp yarn, a passage oriented in the warp yarn direction K. The webs 39, 40 are, along their entire length in the length direction L, spaced from one another by the thickness of the approximately rectangular envelope 48. They are in this manner laterally mutually offset and are each substantially flat, planar and substantially thinner than the heald body 8 in the vicinity of the yarn eyelet. They are set on the heald body 8 transversely to the warp yarn direction K at locations spaced from one another which is particularly well seen in FIG. 12.

Figure 10:
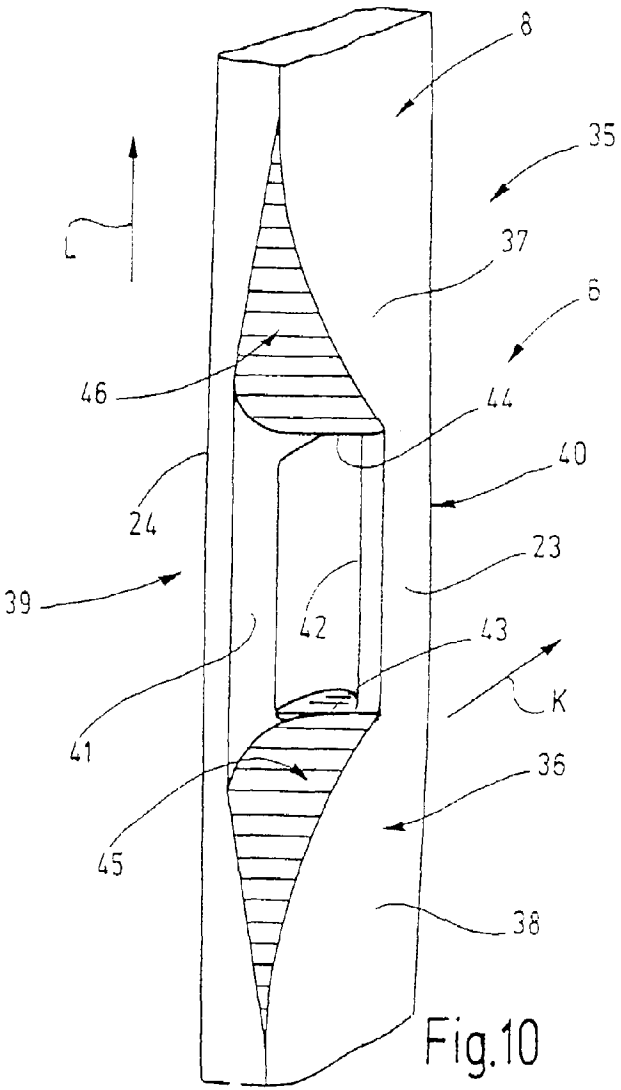
FIG. 10 is a detail view of the yarn eyelet of a modified embodiment of the heald according to FIG. 8.

The yarn eyelet 6 is bounded at its upper and lower ends by respective, preferably essentially planar or groove-shaped yarn guiding surfaces 43, 44. They may flare in a funnel-like manner particularly toward the yarn-inlet side, but also, as shown in FIG. 10, toward the rearward located-yarn-outlet side, to be able to properly guide warp yarns, particularly those which are under low yarn tension. The upper and the lower yarn-inlet surface 45, 46 respectively border a sturdy portion of the heald body 8, on which the regions 37, 38 of the lateral surface 23 are formed as spacer means 35, 36.

Figure 11:
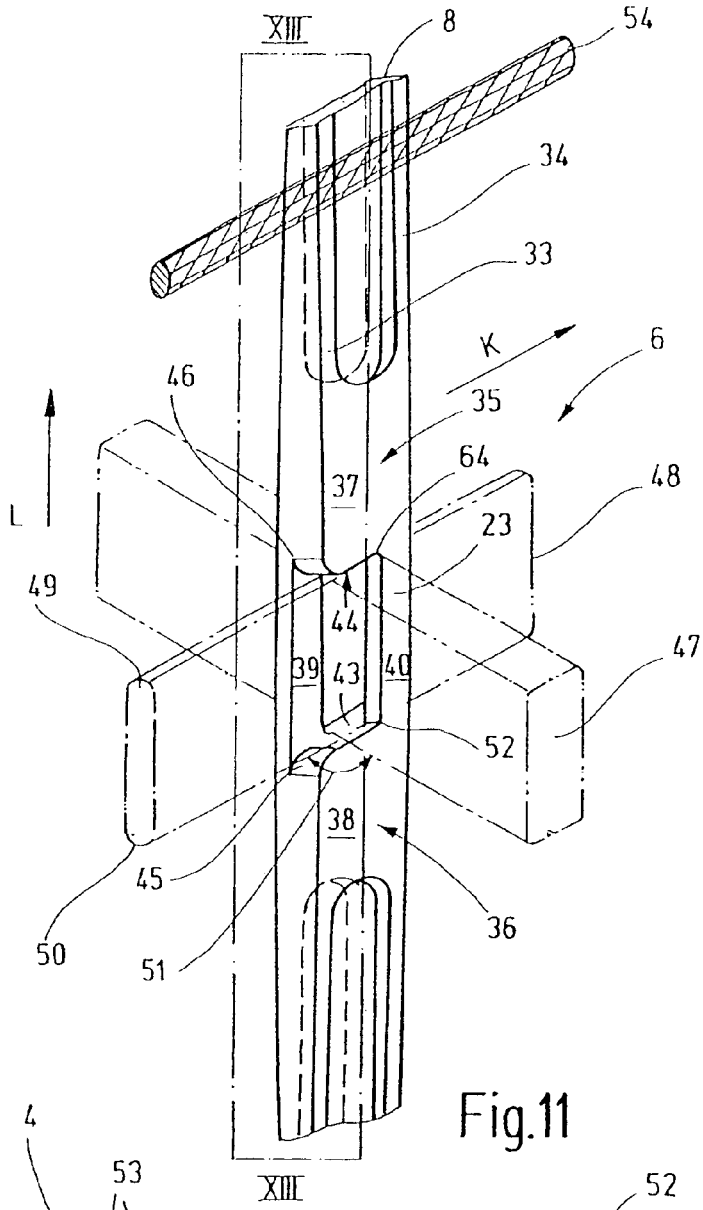
FIG. 11 is a perspective schematic illustration of the heald according to FIG. 8, showing geometrical relationships.
Figure 13:
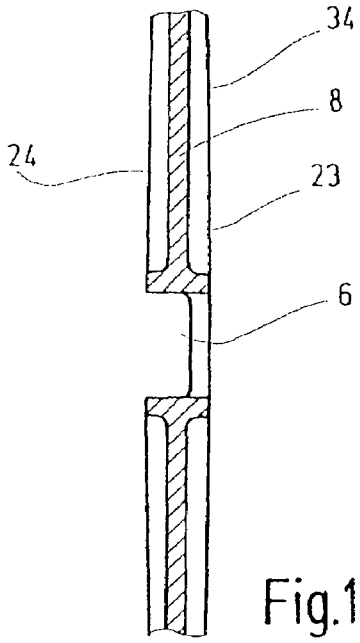
FIG. 13 is a vertical section of the heald according to FIG. 11.

FIG. 11 further illustrates the geometry of the yarn eyelet 6, also in conjunction with FIG. 13 which shows the section XIII-XIII. The webs 39, 40 are not necessarily, but preferably narrower than the heald body 8 in the warp yarn direction K. In this manner they open, in the transverse direction, a passage which is shown in dash lines by an envelope 47 in FIG. 11 and whose width is determined by the distance in the warp direction (that is, by the distance measured in the warp yarn direction K) of the webs 39, 40 from one another. The passage described by the envelope 47 is rectangular and has rounded edges. This passage permits a mechanized draw-in of the warp yarns. Further, the webs 39, 40 are offset from one another transversely relative to the warp yarn direction K, to thus define a longitudinal passage, that is, a passage which extends in the warp yarn direction K and which is represented by the envelope 48. The latter likewise describes an approximately rectangular cross section; the upper and lower narrow sides 49, 50 may be rounded. This is the case when the yarn guiding surfaces 43, 44 are approximately groove shaped. The width of the envelope 48 is determined by the transverse distance of the webs 39, 40.

The angle 51 between the envelopes 47, 48 is preferably at least 30°; in the present instance it amounts to 90°. Further, the envelope 47 is preferably wider than the envelope 48. It is sufficient for the latter if its width equals that of the warp yarn to be guided. In the yarn eyelet 6 of FIG. 11 too, the yarn-inlet surfaces 45, 46 are rounded although to an extent substantially less exaggerated than illustrated in FIG. 10. Further, as a departure from FIG. 10, they do not terminate in a point, but run out along their entire width. Such a shape of the yarn-inlet surfaces 45, 46 is particularly advantageous when working with highly tensioned warp yarns. Further, again, the junctions of the webs 33, 34 are provided with rounded portions 64, 52 to lend the envelope 47 rounded edges.

Figure 12:
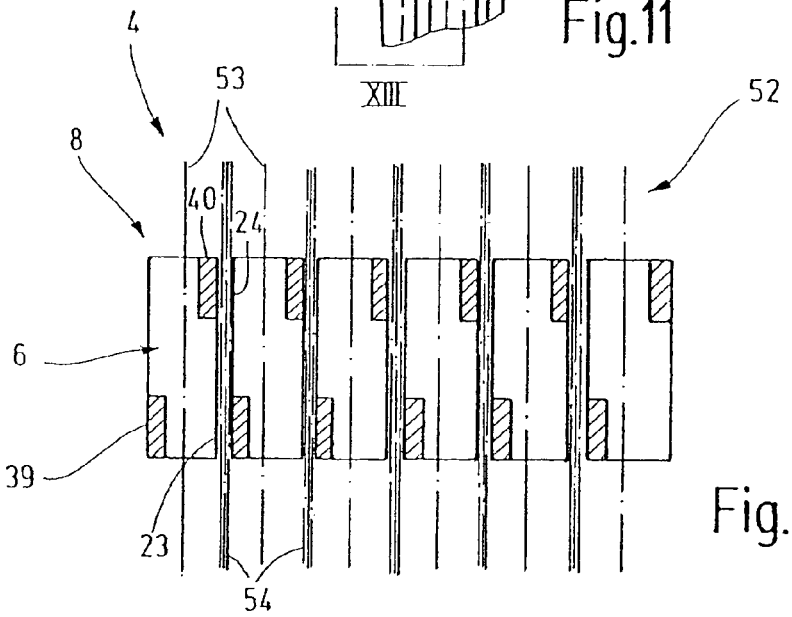
FIG. 12. shows a row of healds illustrated in section at the height of their yarn eyelet, with schematically indicated warp yarns.

The healds 4 described up to this point operate as follows:

FIG. 12 illustrates a row of healds 4 with a warp yarn assembly 52. The warp yarns 53 run through the yarn eyelets 6 while, as a rule, several warp yarns 54 run between the healds 4 and thus brush against the lateral surfaces 23, 24. In individual instances, between the healds 4 merely one or two yarns 54 may run. During the weaving process, only the heald shaft with the healds 4 is reciprocated in a rapid succession in the length direction L (perpendicularly to the drawing plane of FIG. 12) to open and close sheds with the warp yarns 53, 54. During one-motion phase the heald 4 of FIG. 11 moves upward, while the warp yarn 54 brushes against the lateral surface 23 of that heald. During such an occurrence the warp yarn can touch only one surface oriented in the warp yarn direction K, that is, it runs neither over the edges nor over surface regions even if the latter are oriented only obliquely to the warp yarn direction K. In particular, the warp yarn 54 traverses over the yarn eyelet 6 without having to excessively spread apart the healds 4. The latter may, with their planar lateral surfaces 23, 24, lie on one another, while, however, no part of an adjoining heald, not even a web 39, 40, may penetrate into the region of the envelope 48 of the yarn eyelet 6 belonging to the adjoining heald. Such an occurrence is prevented by the regions 37, 38 which belong to the lateral surface 23. The regions 37, 38 extend over the entire width of the lateral surface 23 and constitute the spacer means 35, 36.

The surface regions 37, 38 lie in a common plane with the outer side of the web 40, they adjoin the latter upward and downward relative to the length direction L and extend, in case the web 40 is situated at the rearward end of the heald body 8 relative to the warp yarn direction K, up to the frontal end of the heald body 8. In case the web is arranged at the frontal narrow side, as, for example, the web 39, the respective surface regions, lying in the same plane, extend up to the rearward narrow side of the heald body 8.

It is to be noted that the transverse passage represented by the envelope 47 may be dispensed with; this depends from the extent of automation of the yarn draw-in. The webs 39, 40 extend in such a case, for example, over the entire width or almost the entire width of the heald body 8 as viewed in the warp yarn direction K and leave free only the narrow passage having the envelope 48.

Figure 14:
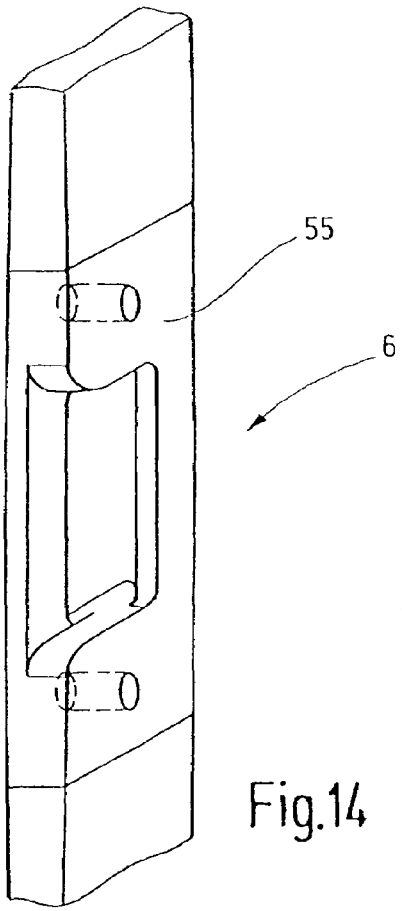
FIG. 14 is a schematic, fragmentary perspective view of a heald having a yarn eyelet insert.
Figure 15:
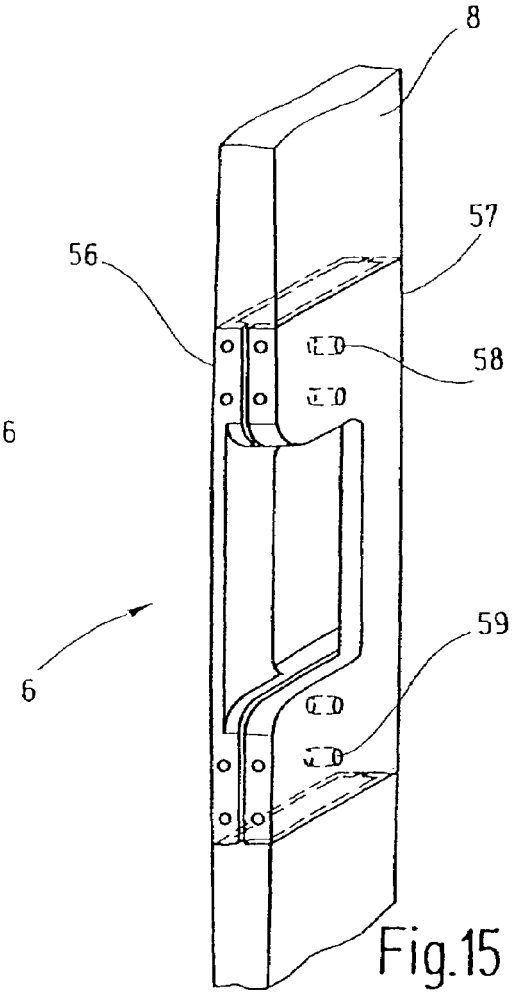
FIG. 15 is a schematic, fragmentary perspective view of a modified embodiment of a heald having yarn eyelet inserts.

FIGS. 14 and 15 show modified embodiments of the previously described heald 4. The external geometry of the modified embodiments agrees with that of the previously described heald 4, so that reference is being made to the description thereof. As a departure from the earlier described heald 4, the yarn eyelet 6 is formed of one or more additional parts 55, 56, 57 which define the shape of the yarn eyelet 6. The additional parts 55 to 57 may be made of a special, wear-resistant material, such as ceramic, cast or forged anodized aluminum, tempered steel, tungsten carbide or coated tungsten carbide or may be made, for example, with a PKD coating. It is feasible to connect the additional components with the remainder of the heald body 8 by means of a form-fit and/or a material bond, by casting-on, casting-around, soldering, welding, gluing or by similar measures. In the embodiment according to FIG. 15 the additional parts 56, 57 form shell-shaped elements which are held on the heald body 8 by means of anchoring pins 58, 59.

The heald 4 according to the invention has a heald body 8, whose thickness increases toward the yarn eyelet 6. The lateral surfaces 23, 24 of the heald body 8 constitute guiding surfaces which are oriented in the warp yarn direction and which, adjacent the yarn eyelet 6, serve as spacer-means 35, 36 for holding at a distance adjoining yarn eyelets 6 of adjoining healds.

List of Reference Characters:

| | |
|---|---|
| 1 | weaving machine |
| 3 | heald shaft |
| 4 | heald |
| 4a, 4b | adjoining healds |
| 5 | warp yarn |
| 6 | yarn eyelet |
| 7 | shaft drive |
| 8 | heald body |
| 9, 10 | end eyelets |
| 11, 12 | serial holes |
| 13, 14 | partial slots |
| 15, 16, 17, 18 | severing edges |
| 19, 20 | angled hooks |
| 21 | projection |
| 22 | transverse pin |
| 23, 24 | lateral surfaces |
| 25, 26, 27, 28 | rounded edges |
| 29, 30, 31, 32 | recesses |
| 33, 34, 62, 63 | webs |
| 35, 36 | spacer means |
| 37, 38 | lateral surface regions |
| 39, 40 | webs |
| 41, 42 | guiding surfaces |
| 43, 44 | yarn guiding surfaces |
| 45, 46 | yarn-inlet surface |
| 47, 48 | envelope |
| 49, 50 | narrow side |
| 51 | angle |
| 64, 52 | rounded portions |
| 52 | warp yarn assembly |
| 53, 54 | warp yarns |
| 55, 56, 57 | additional parts |
| 58, 59 | anchoring pins |
| 60, 61 | holes |
| K | warp yarn direction |
| L | length direction |

The invention claimed is:

1. A heald for a heald shaft, comprising an elongated heald body defining a length direction (L) and having opposite lateral surfaces and a yarn eyelet for receiving a warp yarn defining a warp yarn direction (K); the yarn eyelet constituting a passage oriented transversely to the length direction (L), and wherein the lateral surfaces are oriented in the warp yarn direction (K); the distance between the opposite lateral surfaces, and thus the thickness of the heald body, decreases in a direction away from the yarn eyelet; and the lateral surfaces extend in their full width, measured in the warp yarn direction (K), onto and from the yarn eyelet and provide a spacer means, at the yarn eyelet, for preventing the overlap of eyelets of adjacent healds in a heald shaft.

2. The heald as defined in claim 1, wherein the heald body has a wear-resistant insert at the yarn eyelet.

3. The heald as defined in claim 2, wherein the insert is of ceramic, a cermet, tungsten carbide or a hard metal.

4. The heald as defined in claim 1, wherein the heald body is provided with end eyelets which are seamlessly formed thereon and are of the same material as the heald body.

5. The heald as defined in claim 1, wherein end eyelets are appended on the heald body.

6. A heald shaft comprising healds as defined in claim 1.

7. The heald as defined in claim 1, wherein the lateral surfaces have rounded frontal and rearward edges relative to the warp yarn direction (K).

8. The heald as defined in claim 1, wherein the lateral surfaces are planar surfaces in the region of the yarn eyelet.

9. The heald as defined in claim 1, wherein at least one of the lateral surfaces is inclined to the length direction L and thus constitutes a ramp surface.

10. The heald as defined in claim 9, wherein the ramp surface is a planar surface.

11. The heald as defined in claim 1, wherein the distance between the oppositely located lateral surfaces at the yarn eyelet is greater than the width of the yarn eyelet measured in the same direction.

12. The heald as defined in claim 1, wherein the yarn eyelet is bordered in the warp yarn direction (K) in the front, as well as in the warp yarn direction (K) in the back, by a respective web, whose outer side is formed by a portion of the lateral surface and which, at its inner side, has a guiding surface oriented parallel to the lateral surface at least relative to the warp yarn direction (K).

13. The heald as defined in claim 1, wherein arcuate yarn-inlet surfaces are provided on the yarn-inlet side and/or the yarn-outlet side of the yarn eyelet.

14. The heald as defined in claim 1, wherein the eyelet is bounded by a respective web in the front in the warp yarn direction (K), as well as in the back in the warp yarn direction (K), and between the webs a warp direction distance is present as viewed in the warp yarn direction (K).

15. The heald as defined in claim 14, wherein the warp direction distance is greater than a transverse distance of the webs from one another, measured transversely to the warp yarn direction (K).

16. The heald as defined in claim 1, wherein the heald body has, at its yarn eyelet, a maximum width which decreases in a direction away from the yarn eyelet.

17. The heald as defined in claim 1, wherein at least one of the lateral surfaces is interrupted by at least one recess.

18. The heald as defined in claim 17, wherein the recess is formed by a groove extending in the length direction (L).

19. The heald as defined in claim 1, wherein the heald body is at least partially of a plastic or a light metal.

20. The heald as defined in claim 1, wherein the heald body is of a fiber-composite material.

21. The heald as defined in claim 1, wherein the heald body is seamlessly formed of one and the same material.

22. The heald as defined in claim 1, wherein the heald body has a wear-reducing coating.

23. The heald as defined in claim 16, wherein: at least one of the lateral surfaces is inclined to the length direction L and forms a planar ramp surface that extends to the yarn eyelet at the widest portion of the heald body.

* * * * *